US008961202B2

(12) United States Patent
Busson, Jr.

(10) Patent No.: US 8,961,202 B2
(45) Date of Patent: Feb. 24, 2015

(54) ELECTRICAL SAFETY DEVICE

(71) Applicant: Robert P. Busson, Jr., Hastings, MI (US)

(72) Inventor: Robert P. Busson, Jr., Hastings, MI (US)

( * ) Notice: Subject to any disclaimer, the term of this patent is extended or adjusted under 35 U.S.C. 154(b) by 36 days.

(21) Appl. No.: 13/804,448

(22) Filed: Mar. 14, 2013

(65) Prior Publication Data

US 2014/0273561 A1 Sep. 18, 2014

(51) Int. Cl.
*H01R 13/62* (2006.01)
*H01R 13/44* (2006.01)
*H01R 24/76* (2011.01)

(52) U.S. Cl.
CPC ..... *H01R 13/62* (2013.01); *H01R 13/44* (2013.01); *H01R 24/76* (2013.01)
USPC ..... 439/131

(58) Field of Classification Search
USPC ..... 439/131, 140, 141; 174/66, 67
See application file for complete search history.

(56) References Cited

U.S. PATENT DOCUMENTS

| | | | | | |
|---|---|---|---|---|---|
| 2,396,901 | A * | 3/1946 | Tiffany | 439/140 |
| 2,458,153 | A | 1/1949 | Festge | |
| 3,201,740 | A | 8/1965 | Rubens | |
| 3,210,717 | A * | 10/1965 | Brown | 439/140 |
| 3,631,320 | A | 12/1971 | Eckert | |
| 3,781,913 | A | 12/1973 | Liburdi | |
| 4,179,175 | A * | 12/1979 | Farnworth et al. | 439/140 |
| 4,969,834 | A | 11/1990 | Johnson | |
| 5,030,119 | A * | 7/1991 | Lowe | 439/141 |
| 5,046,961 | A * | 9/1991 | Hoffman | 439/141 |
| 5,108,297 | A * | 4/1992 | Hoffman et al. | 439/134 |
| 5,226,827 | A * | 7/1993 | Corcoles et al. | 439/140 |
| 5,328,387 | A * | 7/1994 | Hoffman | 439/469 |
| 5,518,411 | A * | 5/1996 | Belleci | 439/141 |
| 5,599,196 | A * | 2/1997 | Powell et al. | 439/141 |
| 6,062,881 | A * | 5/2000 | Ellison | 439/141 |
| 6,468,095 | B2 * | 10/2002 | Kerr et al. | 439/140 |
| 6,770,986 | B2 * | 8/2004 | Nagao et al. | 307/326 |
| 7,094,080 | B2 * | 8/2006 | Dickie et al. | 439/141 |
| 7,121,851 | B1 * | 10/2006 | Beatty et al. | 439/131 |
| 2002/0025703 | A1 * | 2/2002 | Chen | 439/141 |
| 2008/0261420 | A1 * | 10/2008 | Riddle | 439/134 |

* cited by examiner

*Primary Examiner* — Alexander Gilman
(74) *Attorney, Agent, or Firm* — Fraser Clemens Martin & Miller LLC; James D. Miller

(57) ABSTRACT

An electrical safety device includes a body having a cavity, a plurality of prongs configured to be received into sockets of an electrical outlet, and a plurality of sockets each of which is configured to receive a prong of an electrical plug therein. The electrical safety device further includes a locking assembly configured to secure the prongs of the electrical plug in the sockets of the body. At least a portion of each of the prongs of the electrical safety device includes at least one insulator disposed thereon and a retractable sheath surrounds each of the prongs of the electrical safety device to militate against an undesired contact therewith.

11 Claims, 5 Drawing Sheets

ELECTRICAL SAFETY DEVICE

FIELD OF THE INVENTION

The present invention relates generally to an electrical safety device and, more particularly, to an electrical safety device which may be attached to an electrical plug for militating against inadvertent contact with prongs of the electrical plug.

BACKGROUND OF THE INVENTION

There is a growing concern for a safety of infants and young children. Particularly, the concern is for children who have not yet reached an age at which they may be reasoned with and instructed as to dangers of household electricity. Such children may typically range in age from that of a toddler up to school aged children who have yet to learn discipline or have yet to reach the age at which they may be spoken to about dangers of certain actions which they might undertake.

Almost any home where such children live or are expected to visit, will possibly have covers placed over any unused wall sockets so as to preclude prying fingers or child-wielded objects from being inserted into the electrical wall sockets. When these covers are in place on unused wall sockets, the danger to a toddler is greatly reduced as the wall socket is not accessible and the covers are difficult to remove. When, however, a household appliance such as a lamp, is plugged into a wall socket, a completely different danger exists. In this instance, the child may be enticed to remove and reinsert the plug into the wall socket. This exposes them to the risk of contacting the prongs of the electrical plug while they are electrified, i.e., while between 110 and 130 volts is imposed across the prongs. If the prongs are inadvertently contacted by the child, there is a high risk of electric shock to the child.

Devices have been proposed in the prior art for minimizing such a risk. One such device is a safety device on a transformer for an electrical appliance. The transformer has electrical prongs projecting outwardly therefrom and a cavity is formed in a housing of the transformer around an area from which the prongs project. An insulator is disposed within the cavity. The insulator is collapsible when the blades are inserted into a wall socket and expandable when the blades are removed from the wall socket. The insulator is in the form of a bellows-like structure that has convoluted and compressible walls.

It would desirable to produce an electrical safety device for use with a standard electrical plug, which minimizes inadvertent contact with electrified prongs of the electrical plug as well as electrified prongs of the electrical safety device.

SUMMARY OF THE INVENTION

In concordance and agreement with the present disclosure, an electrical safety device for use with a standard electrical plug, which minimizes inadvertent contact with electrified prongs of the electrical plug as well as electrified prongs of the electrical safety device, has surprisingly been discovered.

In one embodiment, the electrical device, comprises: a body including a cavity and a plurality of sockets formed therein, each of the sockets configured to receive a prong of an electrical plug therein; and at least one prong at least partially disposed in the cavity of the body, the at least one prong of the electrical device configured to be received into a socket of an electrical outlet, wherein at least a portion of the at least one prong includes at least one insulator disposed thereon.

In another embodiment, the electrical device, comprises: a body including a cavity and a plurality of sockets formed therein, each of the sockets configured to receive a prong of an electrical plug therein; at least one prong at least partially disposed in the cavity of the body, the at least one prong of the electrical device configured to be received into a socket of an electrical outlet; and a locking assembly at least partially disposed in the body, wherein the locking assembly is configured to secure the prongs of the electrical plug in the sockets of the body.

In yet another embodiment, the electrical device, comprises: a body including a cavity and a plurality of sockets formed therein, each of the sockets configured to receive a prong of an electrical plug therein; at least one prong at least partially disposed in the cavity of the body, the at least one prong of the electrical device configured to be received into a socket of an electrical outlet, wherein at least a portion of the at least one prong of the electrical device includes at least one insulator disposed thereon; at least one retractable sheath configured to surround the at least one prong of the electrical device; and a locking assembly at least partially disposed in the body, wherein the locking assembly is configured to secure the prongs of the electrical plug in the sockets of the body.

BRIEF DESCRIPTION OF THE DRAWINGS

The above, as well as other objects and advantages of the invention, will become readily apparent to those skilled in the art from reading the following detailed description of the invention when considered in the light of the accompanying drawings in which.

DETAILED DESCRIPTION OF THE INVENTION

Figure 1:
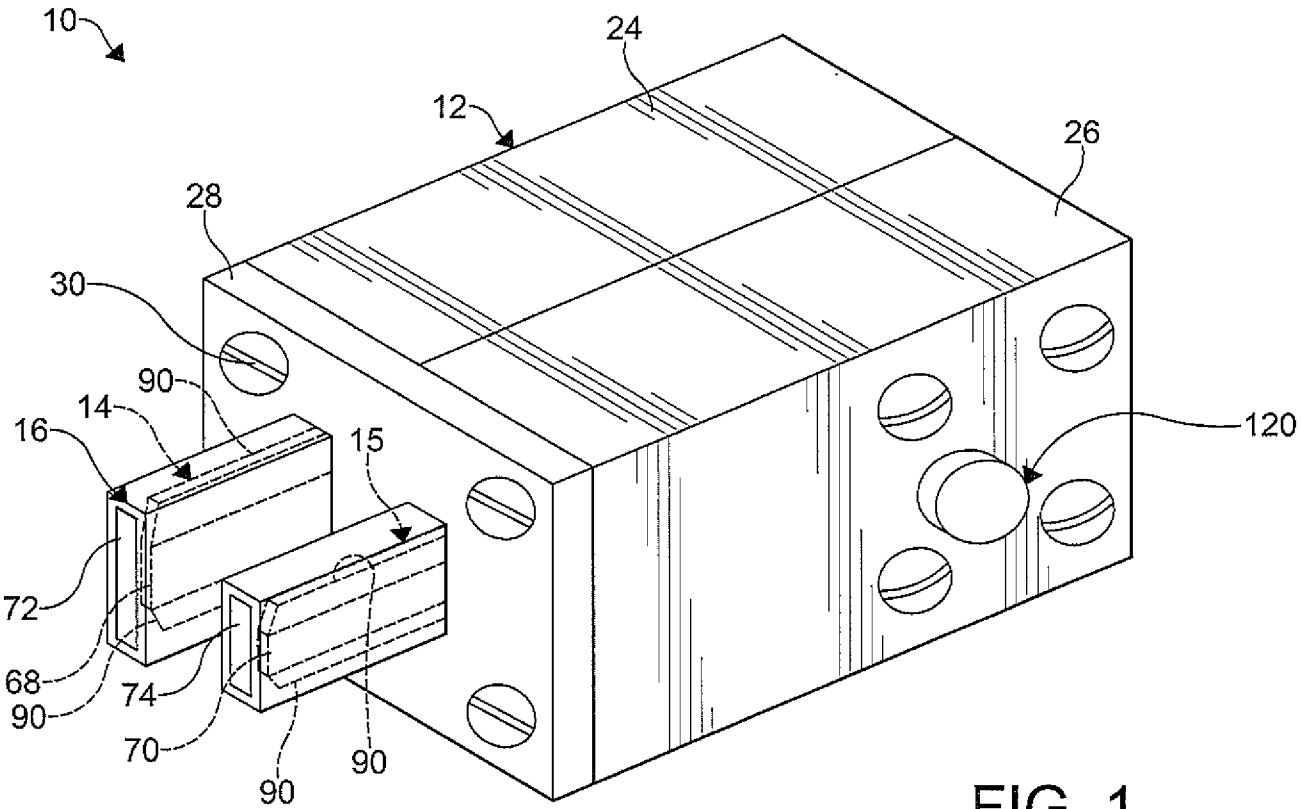
FIG. 1 is a perspective view of an electrical safety device according to an embodiment of the present invention, the electrical safety device including a pair of spaced apart prongs.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-6 depict an electrical safety device 10 according to an embodiment of the present invention. The electrical safety device 10 shown is used as an adapter between an electrical plug 11 (shown in FIGS. 5-6) of an electrical appliance and an electrical outlet or receptacle. The electrical safety device 10 includes a generally hollow body 12 having a core 18, a pair of spaced apart conductive prongs 14, 15, and one or more retractable sheaths 16. The core 18 is provided with a pair of spaced apart of sockets 20, 21 (shown in FIG. 4) for receiving respective prongs 22, 23 of the electrical plug 11. It is understood that the electrical safety device 10 shown is configured to receive a two-prong electrical plug 11. Those skilled in the art will appreciate that the electrical safety device 10 can be easily configured to receive electrical plug having fewer or additional prongs such as a conventional two-prong electrical plug provide with a ground prong, for example. It is also understood that the electrical safety device 10 may include other features not shown such as an indicator (i.e. an audible indicator, a visual indicator, a haptic indicator, etc.) to alert a user whether the electrical plug is secured therein, for example.

Figure 4:
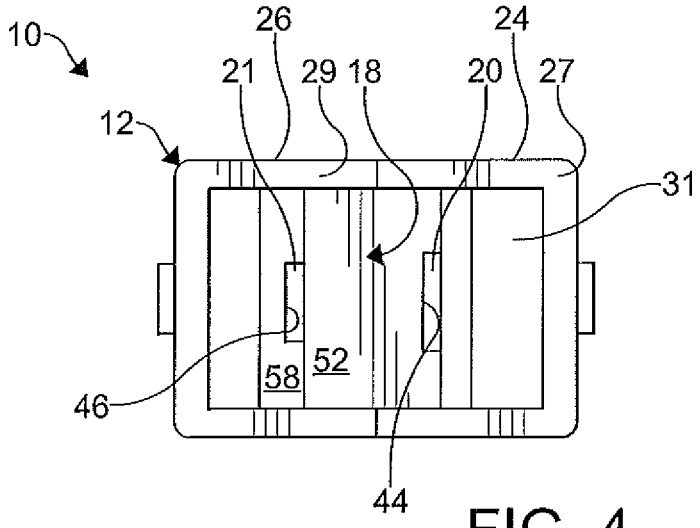
FIG. 4 is a rear elevational view of the electrical safety device illustrated in FIGS. 1-3.
Figure 5:
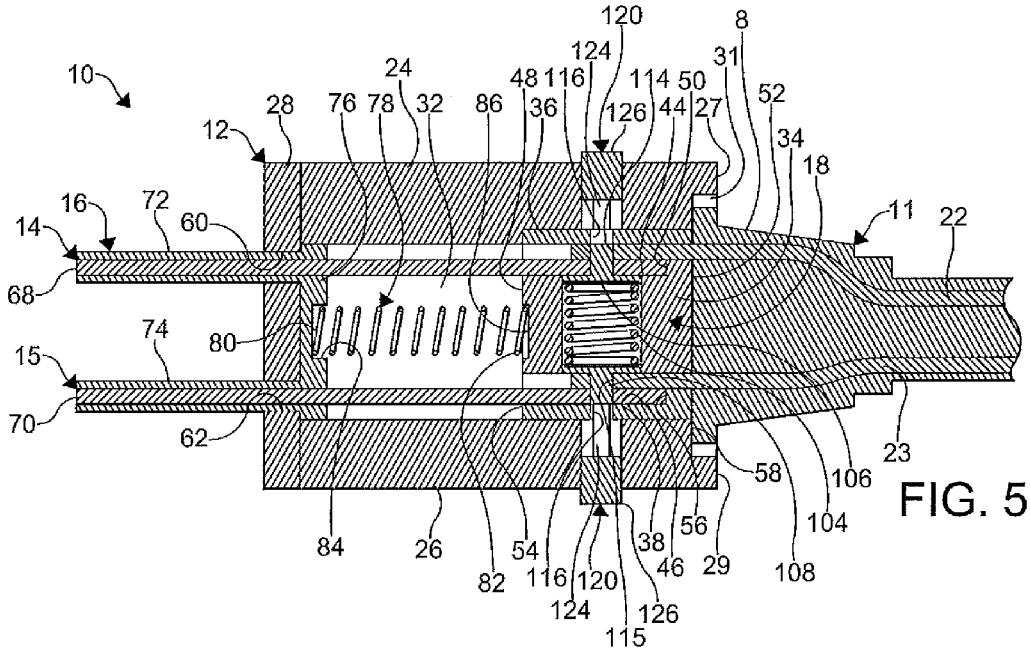
FIG. 5 is a cross-sectional plan view of the electrical safety device illustrated in FIGS. 1-4 taken along line 5-5 of FIG. 1, showing an electrical plug connected thereto and a retractable sheath in a first position.
Figure 6:
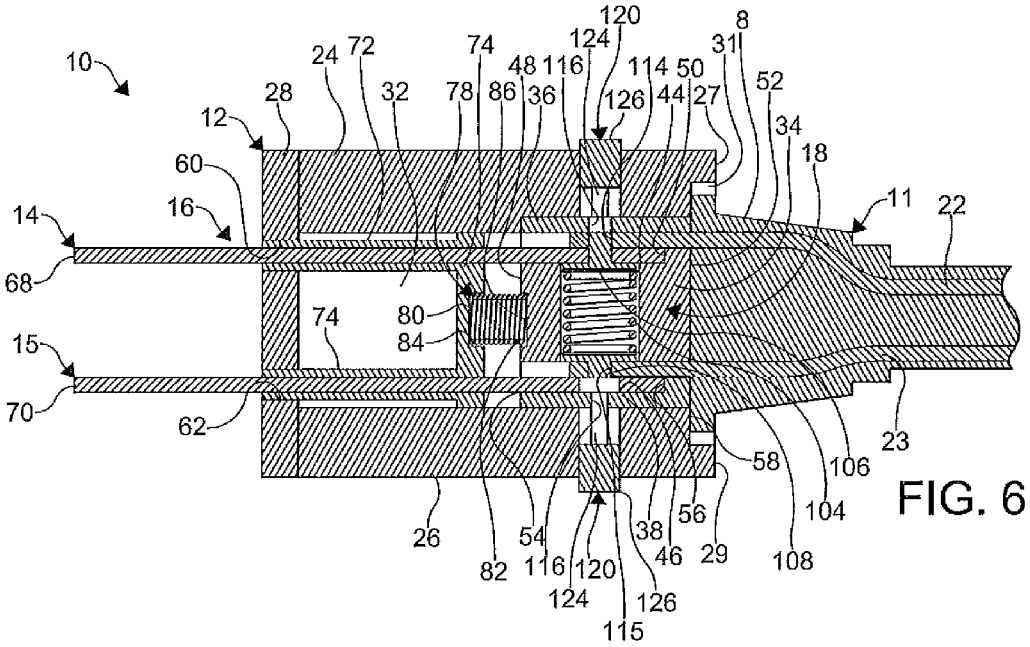
FIG. 6 is a cross-sectional plan view of the electrical safety device illustrated in FIGS. 1-5 taken along line 5-5 of FIG. 1, showing the electrical plug connected thereto and the retractable sheath in a second position.

In certain embodiments, the hollow body 12 includes a first portion 24, a second portion 26, and an end plate 28 coupled to the portions 24, 26. As shown in FIGS. 4-6, each of the portions 24, 26 includes respective raised outer peripheral edges 27, 29 extending laterally outwardly therefrom. The outer peripheral edges 27, 29 cooperate to define a recessed area 31 within the body 12, which is configured to receive a grip portion 8 of the electrical plug 11 and militate against exposure and undesired contact with the prongs 22, 23 of the electrical plug 11.

The end plate 28 shown is coupled to the portions 24, 26 by a plurality of fasteners 30. Various other means can be used to couple the end plate 28 to the portions 24, 26. For example, the portions 24, 26 and the end plate 28 may be releasably or permanently coupled together by an interference fit, an adhesive, or other mechanical connectors. Alternatively, the portions 24, 26 and/or the end plate 28 of the body 12 can be integrally formed to minimize a complexity of the electrical safety device 10. Various forming processes can be used to form the body 12 such as a molding process, a stamping process, a casting process, and the like, for example. Each of the portions 24, 26 and the end plate 28 can be formed from any suitable non-conductive material such as a plastic material, for example. Those skilled in the art will appreciate that the body 12 can have any size, shape, and ornamental appearance as desired to minimize manufacturing and material costs, as well as maximize consumer appeal.

The body 12 includes an inner cavity 32 formed therein. In certain embodiments, the portions 24, 26 and the end plate 28 cooperate to define the cavity 32 therein. The cavity 32 is configured to receive a portion of prongs 14, 15, the sheath 16, and the core 18. It is understood that the cavity 32 can have any shape and size as desire to accommodate the internal components of the electrical safety device 10.

Figure 2:
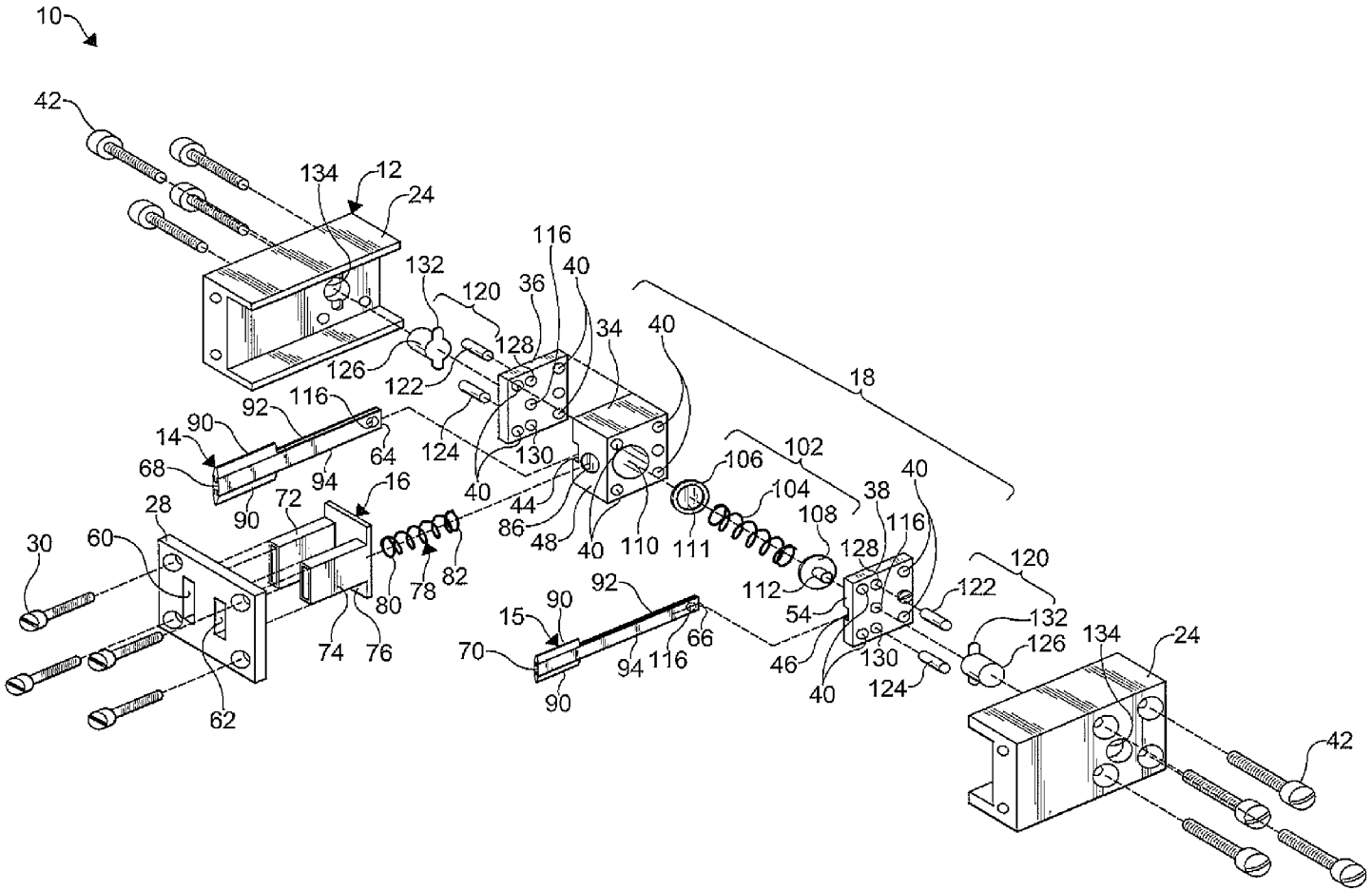
FIG. 2 is an exploded perspective view of the electrical safety device illustrated in FIG. 1.
Figure 3:
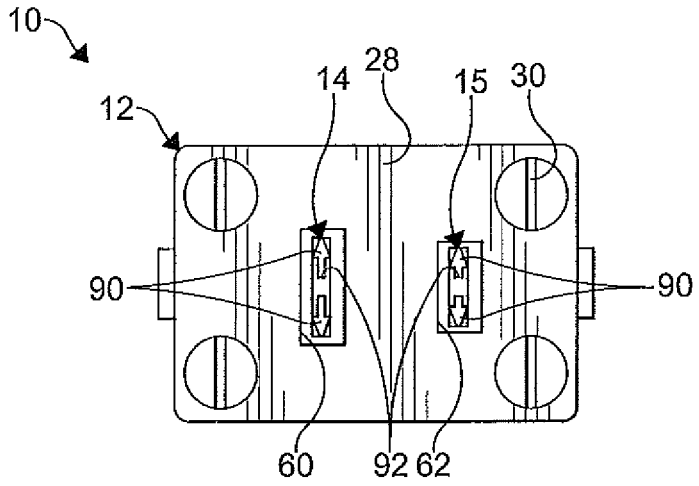
FIG. 3 is a front elevational view of the electrical safety device illustrated in FIGS. 1-2.

As illustrated in FIG. 2, the core 18 includes a central member 34 and a pair of laterally opposed side members 36, 38. Each of the members 34, 36, 38 includes a plurality of apertures 40 formed therein. The members 34, 36, 38 of the core 18 and the portions 24, 26 of the body 12 shown are coupled together by a plurality of fasteners 42 received into the apertures 40. Various other means can be used to couple one or more of the members 34, 36, 38 of the core 18 to one or more of the portions 24, 26 of the body 12. For example, the members 34, 36, 38 of the core 18 and the portions 24, 26 of the body 12 may be releasably or permanently coupled together by an interference fit, an adhesive, or other mechanical connectors. Alternatively, one or more of the members 34, 36, 38 of the core 18 may be integrally formed with one or more portions 24, 26 of the body 12 to minimize a complexity of the electrical safety device 10. Various forming processes can be used to form the core 18 such as a molding process, a stamping process, a casting process, and the like, for example. Each of the members 34, 36, 38 of the core 18 can be formed from any suitable non-conductive material such as a plastic material, for example.

Each of the members 34, 38 shown includes respective channels 44, 46 formed therein. The channel 44 extends from a first surface 48 of the central member 34 and terminates at a shoulder 50 formed adjacent a second surface 52 thereof. Similarly, the channel 46 extends from a first surface 54 of the side member 38 and terminates at a shoulder 56 formed adjacent a second surface 58 thereof. The channels 44, 46 are formed in the members 34, 38 such that when the core 18 is assembled that the channels 44, 46 form the sockets 20, 21, respectively. The channels 44, 46 can have any shape and size to receive both one of the prongs 14, 15 of the electrical safety device 10 and one of the prongs 22, 23 of the electrical plug 11 and maintain electrical connection therebetween. Each of the sockets 20, 21 may include an internal contact (not shown) disposed therein such as a spring-loaded terminal, for example, to enhance the electrical connection between the prong 14 of the electrical safety device 10 and the prong 22 of the electrical plug 11 and between the prong 15 of the electrical safety device 10 and the prong 23 of the electrical plug 11.

As illustrated in FIG. 6, the prongs 14, 15 of the electrical safety device 10 extend from within the respective channels 44, 46 of the core 18, through the cavity 22 and respective apertures 60, 62 formed in the end plate 28, and laterally outwardly from the end plate 28. A first end 64 of the prong 14 is disposed adjacent the shoulder 50 of the central member 34 such that the shoulder 50 covers the first end 64 and militates against an undesired exposure thereof. Likewise, a first end 66 of the prong 15 is disposed adjacent the shoulder 56 of the side member 38 such that the shoulder 56 covers the first end 66 and militates against an undesired exposure thereof. As shown, a second end 68 of the prong 14 and a second end 70 of the prong 15 are surrounded by respective laterally outwardly extending skirt portions 72, 74 of the sheath 16.

In certain embodiments, the sheath 16 is a unitary structure having the skirt portions 72, 74 integrally formed with a base 76. The sheath 16 is slidingly disposed in the cavity 32 of the body 12 and may be retracted from a first position (shown in FIG. 5) to a second position (shown in FIG. 6) against a biasing force of an urging mechanism 78 such as a spring, for example. Opposing ends 80, 82 of the urging mechanism 78 may be received in recessed areas 84, 86, respectively, to maintain a desired position of the urging mechanism 78 between the base 76 of the sheath 16 and the first surface 48 of the central member 34. The biasing force of the urging mechanism 78 is such that it urges the sheath 16 towards the second ends 68, 70 of the prongs 14, 15 to provide desired coverage thereof, yet militates against disengagement of the electrical safety device 10 from the electrical outlet.

In other embodiments, each of the ends 68, 70 of the prongs 14, 15, respectively, is surrounded by a skirt portion (not shown) of an individual retractable sheath (not shown). Each of the sheaths are slidingly disposed within the cavity 32 of the body 12 and may be retracted from a first position to a second position against a biasing force of a corresponding urging mechanism (not shown) such as a spring, for example.

Figure 7:
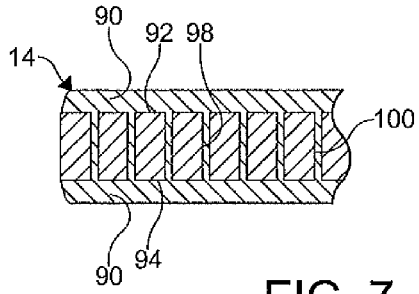
FIG. 7 is an enlarged cross-sectional view of one of prongs illustrated in FIGS. 1-6.

As illustrated in FIG. 7, each of the second ends 68, 70 of the respective prongs 14, 15 includes one or more insulators 90 formed from a non-conductive material. In certain embodiments, one of the insulators 90 is formed along a portion of a first edge 92 and another one of the insulators 90 is formed along a portion of a second edge 94 of each of the prongs 14, 15. As a non-limiting example, each of the insulators 90 is disposed in a corresponding groove 96 formed in the edges 92, 94 of the prongs 14, 15 to secure the insulators 90 thereon. An adhesive (not shown) may be employed to further secure the insulators 90 within the grooves 96 if desired. In other embodiments shown in FIG. 7, each of the prongs 14, 15 may include a linear array of through holes 98 formed therein. The through holes 98 are configured to receive the non-conductive material therein during a forming of the insulators 90 on the prongs 14, 16. Accordingly, a plurality of cross-members 100 is formed which interconnects the insulators 90 formed on the edges 92, 94 of the prongs 14, 15, thereby increasing a structural stability of the insulators 90. Those skilled in the art will appreciate that the insulator 90 can be disposed on the prongs 14, 15 by any suitable means as desired such as cast as part of the prongs 14, 15, press fit into the prongs 14, 15, and the like, for example.

In certain embodiments, the electrical safety device 10 may further include a locking assembly 102 for releasably engaging the prongs 22, 23 of the electrical plug 11. As shown in FIG. 2, the locking assembly 102 includes an urging mechanism 104 interposed between a pair of spaced apart locking pins 106, 108. The urging mechanism 104 and the locking pins 106, 108 are received in a bore 110 formed in the central member 34 of the core 18. Each of the locking pins 106, 108 may include a recessed area 111 formed therein to maintain a desired position of the urging mechanism 104 therebetween. Each of the locking pins 106, 108 includes a portion 112 extending laterally outwardly therefrom. A biasing force of the urging mechanism 104 causes the portions 112 of the locking pins 106, 108 to be releasably received into associated apertures 114, 115 formed in the prongs 22, 23, respectively, of the conventional electrical plug 11 to secure the electrical plug 11 thereto. It is understood that the portion 112 of the locking pins 106, 108 can extend through the apertures 114, 115 of the prongs 22, 23 and into apertures 116 formed in at least one of the prongs 14, 15 and the side members 36, 38 of the core 18 of the electrical safety device 10 to further enhance engagement between the electrical safety device 10 and the electrical plug 11.

Each of the locking pins 106, 108 of the locking assembly 102 is configured to be released by an actuating mechanism 120. Each of the actuating mechanisms 120 shown in FIG. 2 includes a pair of contact pins 122, 124 and an actuator 126. It is understood that the contact pins 122, 124 and the actuator 126 can be integrally formed as a unitary component if desired. A first end of each of the contact pins 122, 124 extends through corresponding apertures 128, 130 formed in the side members 34, 38 of the core 18 to abut the locking pins 106, 108. A second end of the contact pins 122, 124 abuts diametrically opposed ears 132 formed on a first end of the actuator 126. A second end of each of the actuators 126 extends through a corresponding aperture 134 formed in the respective portions 24, 26 of the body 12.

In operation, the actuators 126 of the actuating mechanism 120 are pressed together causing the ears 132 to engage the contact pins 122, 124. The contact pins 122, 124 engage portions of the locking pins 106, 108 causing the urging mechanism 104 to be compressed. As the urging mechanism 104 compresses, the contact pins 122, 124 cause the portions 112 of the locking pins 106, 108 to move towards each other, and out of the sockets 20, 21 of the electrical safety device 10. Thereafter, the prongs 22, 23 of the electrical plug 11 are inserted into the sockets 20, 21 of the electrical safety device 10. The actuators 126 are then released, causing the portions 112 of the locking pins 106, 108 to extend through the apertures 114, 115 of the prongs 22, 23 and secure the electrical plug 11 therein. The electrical plug 11 is received into the electrical safety device 10 in such a manner that the outer peripheral edges 27, 29 provide coverage and militate against exposure of any portion of the prongs 22, 23 not received into the sockets 20, 21.

Once the electrical plug 11 is securely engaged by the locking assembly 102, the electrical safety device 10 is disposed into the electrical outlet. As the prongs 14, 15 of the electrical safety device 10 are inserted into sockets of the electrical outlet, contact with a face plate of the electrical outlet causes the sheath 16 to retract from the first position shown in FIG. 5 to a position intermediate the first position and the second position shown in FIG. 6. However, the sheath 16 continues to maintain coverage of portions of the electrified prongs 14, 15 that are not received into the electrical outlet. Further, the insulators 90 disposed on the prongs 14, 15 provide additional protection against exposure of the electrified prongs 14, 15.

When removal of the electrical plug 11 is desired, the electrical safety device 10 is removed from the electrical outlet. As the electrical safety device 10 is removed, the urging mechanism 78 causes the sheath 16 to move from the position intermediate the first position and the second position to the first position, maintaining coverage of the prongs 14, 15. Once the electrical safety device 10 has been removed from the electrical outlet, the electrical plug 11 can be removed therefrom. To remove the electrical plug 11 from the electrical safety device 10, the actuators 126 of the actuating mechanism 120 are pressed together causing the ears 132 to engage the contact pins 122, 124. The contact pins 122, 124 engage portions of the locking pins 106, 108 causing the urging mechanism 104 to be compressed. As the urging mechanism 104 compresses, the contact pins 122, 124 cause the portions 112 of the locking pins 106, 108 to be removed from the apertures 114, 115 of the prongs 22, 23 of the electrical plug 11, thereby releasing the electrical plug 11. Once the electrical plug 11 is released from the locking assembly 102, the electrical plug 11 can be easily removed from the electrical safety device 10.

Figure 8:
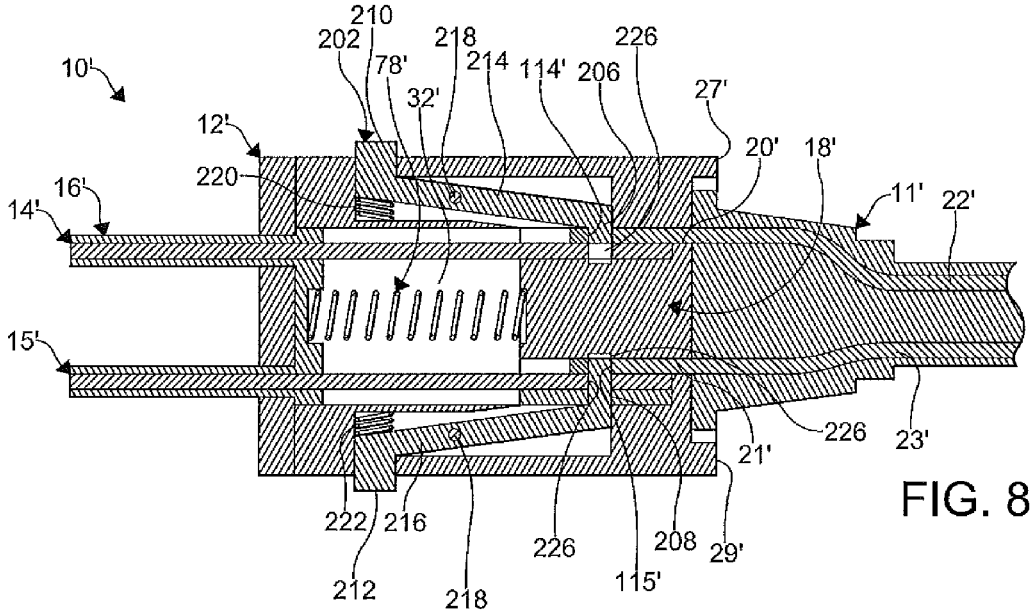
FIG. 8 is a cross-sectional plan view of an electrical safety device according to another embodiment of the present invention.

FIG. 8 shows another embodiment of the electrical safety device 10 illustrated in FIGS. 1-6. Structure similar to that illustrated in FIGS. 1-6 includes the same reference numeral and a prime (') symbol for clarity. In FIG. 8, the electrical safety device 10' is substantially similar to the electrical safety device 10, except the electrical safety device 10' includes an alternative locking assembly 202 for releasably engaging the prongs 22', 23' of the electrical plug 11', and the core 18' does not have the bore 110 formed therein.

The locking assembly 202 includes a pair of spaced apart locking pins 206, 208 coupled to a pair of actuators 210, 212, respectively, by respective arm members 214, 216. Each of the arm members 214, 216 shown is configured to pivot about a pivot pin 218 from a locked or first position shown in FIG. 8 to a released or second position. The locking pins 206, 208 can be coupled to the actuators 210, 212 such as by a mechanical connection, an electro-mechanical connection, or an electrical connection, for example. Additional or fewer locking pins, actuators, and/or arm members than shown can be employed if desired. As shown, the locking pin 206, the actuator 210, and the arm member 214 are integrally formed as a unitary component, and the locking pin 208, the actuator 212, and the arm member 216 are integrally formed as a unitary component. At least a portion of the locking pins 206, 208 extending laterally outwardly from the arm members 214, 216 is configured to be releasably received into associated apertures 114', 115' formed in the prongs 22', 23', respectively, of the conventional electrical plug 11' to secure the electrical plug 11' thereto.

A biasing force of urging mechanisms 220, 222 (e.g. springs) causes the respective arm members 214, 216 to be maintained in the first position. It is understood that an end of the urging mechanisms 220, 222 may be received into a recessed area (not shown) formed in the body 12' of the electrical safety device 10' to maintain a desired position thereof. In the first position of the arm members 214, 216, each of the actuators 210, 212 extend laterally outwardly from the body 12' of the electrical safety device 10' and each of the locking pins 206, 208 extend through apertures 114', 115' formed in the prongs 22', 23' of an electrical plug 11'. It is understood that the portions of the locking pins 206, 208 can extend through the apertures 114', 115' of the prongs 22', 23' and into apertures 226 formed in at least one of the prongs 14', 15' and the core 18' of the electrical safety device 10' to further enhance engagement between the electrical safety device 10' and the electrical plug 11'.

In operation, the actuators 210, 212 are pressed together causing the urging mechanisms 220, 222 to be compressed and the arm members 214, 216 to pivot about the pivot pins 218 from the first position shown in FIG. 8 to the second position. As the arm members 214, 216 pivot, the locking pins 206, 208 move away each other, and out of the sockets 20', 21' of the electrical safety device 10'. Thereafter, the prongs 22', 23' of the electrical plug 11' are inserted into the sockets 20', 21' of the electrical safety device 10'. The actuators 210, 212 are then released, causing the arm members 214, 216 to pivot about the pivot pins 218 from the second position to the first position shown in FIG. 8. As the arm members 214, 216 pivot, the locking pins 206, 208 are caused to extend through the apertures 114', 115' of the prongs 22', 23', securing the electrical plug 11' therein. The electrical plug 11' is received into the electrical safety device 10' in such a manner that the outer peripheral edges 27', 29' provide coverage and militate against exposure of any portion of the prongs 22', 23' not received into the sockets 20', 21'.

Once the electrical plug 11' is securely engaged by the locking assembly 202, the electrical safety device 10' is disposed into the electrical outlet. As the prongs 14', 15' of the electrical safety device 10' are inserted into sockets of the electrical outlet, contact with a face plate of the electrical outlet causes the sheath 16' to retract into the cavity 32' from the first position to a position intermediate the first position and the second position. However, the sheath 16' continues to maintain coverage of portions of the electrified prongs 14', 15' that are not received into the electrical outlet. Further, the insulators 90' disposed on the prongs 14', 15' provide additional protection against exposure of the electrified prongs 14', 15'.

When removal of the electrical plug 11' is desired, the electrical safety device 10' is removed from the electrical outlet. As the electrical safety device 10' is removed, the urging mechanism 78' causes the sheath 16' to move from the position intermediate the first position and the second position to the first position, maintaining coverage of the prongs 14', 15'. Once the electrical safety device 10' has been removed from the electrical outlet, the electrical plug 11' can be removed therefrom. To remove the electrical plug 11' from the electrical safety device 10', the actuators 210, 212 are pressed together causing the urging mechanisms 220, 222 to be compressed and the arm members 214, 216 to pivot about the pivot pins 218 from the first position to the second position. As the arm members 214, 216 pivot, the locking pins 206, 208 move away each other are caused to be removed from the apertures 114', 115' of the prongs 22', 23' of the electrical plug 11', thereby releasing the electrical plug 11'. Once the electrical plug 11' is released from the locking assembly 202, the electrical plug 11' can be easily removed from the electrical safety device 10'.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An electrical device, comprising:

a body including a cavity and a plurality of sockets formed therein, each of the sockets formed in a first side of the body and configured to receive a prong of an electrical plug therein;

at least one prong at least partially disposed in the cavity of the body, the at least one prong of the electrical device extending from a second side of the body and configured to be received into a socket of an electrical outlet, wherein at least a portion of the at least one prong includes at least one insulator disposed thereon; and a locking assembly at least partially disposed in the body and having at least one locking pin, wherein the at least one locking pin is configured to be releasably received in the prong of the electrical plug.

2. The electrical device of claim 1, further comprising at least one retractable sheath configured to surround the at least one prong of the electrical device.

3. The electrical device of claim 1, wherein the at least one insulator is received in a groove formed in at least one of a first edge and a second edge of the at least one prong.

4. The electrical device of claim 1, wherein the at least one prong has a plurality of insulators disposed thereon, and the insulators are interconnected by at least one cross-member formed through the at least one prong.

5. The electrical device of claim 1, wherein the at least one insulator is affixed to the at least one prong by at least one of an adhesive and a press fit.

6. The electrical device of claim 1, wherein the at least one locking pin is a plurality of spaced apart locking pins and the locking assembly includes an urging mechanism interposed between the spaced apart locking pins.

7. The electrical device of claim 1, wherein the at least one locking pin is coupled to an actuator by an arm member.

8. The electrical device of claim 1, further comprising at least one actuating mechanism configured to selectively release the locking assembly.

9. The electrical device of claim 8, wherein the actuating mechanism includes a contact pin and an actuator configured to abut the contact pin.

10. An electrical device, comprising:

a body including a cavity and a plurality of sockets formed therein, each of the sockets formed in a first side of the body and configured to receive a prong of an electrical plug therein;

at least one prong at least partially disposed in the cavity of the body, the at least one prong of the electrical device extending from a second side of the body and configured to be received into a socket of an electrical outlet, wherein at least a portion of the at least one prong of the electrical device includes at least one insulator disposed thereon;

at least one retractable sheath configured to surround the at least one prong of the electrical device; and a locking assembly at least partially disposed in the body, wherein the locking assembly is configured to secure the prongs of the electrical plug in the sockets of the body, the locking assembly including an actuating mechanism configured to selectively release the locking assembly.

11. The electrical device of claim 10, wherein the actuating mechanism includes a contact pin and an actuator configured to abut the contact pin.

* * * * *